US005465601A

United States Patent [19]

Jowitt et al.

[11] Patent Number: 5,465,601

[45] Date of Patent: Nov. 14, 1995

[54] RAM FOR LONG STROKE PRESS

[75] Inventors: Frederick W. Jowitt, Yorkshire; Paul Simms, West Yorkshire, both of England

[73] Assignee: Carnaudmetalbox plc, United Kingdom

[21] Appl. No.: 179,915

[22] Filed: Jan. 11, 1994

[30] Foreign Application Priority Data

Jan. 26, 1993 [GB] United Kingdom ..... 9301488

[51] Int. Cl.[6] ..... B21D 37/01

[52] U.S. Cl. ..... 72/347; 72/479

[58] Field of Search ..... 72/273, 347, 349, 72/479

[56] References Cited

U.S. PATENT DOCUMENTS

| | | | |
|---|---|---|---|
| 3,402,591 | 9/1968 | Maeder | 72/349 |
| 3,733,881 | 5/1973 | Grigorenko . | |
| 4,425,820 | 1/1984 | Swozil . | |
| 4,541,304 | 9/1985 | Chikugo et al. . | |
| 4,779,442 | 10/1988 | Welsh . | |
| 5,018,915 | 5/1991 | Inokuma et al. | 408/238 |
| 5,095,730 | 3/1992 | Lauder | 72/347 |

FOREIGN PATENT DOCUMENTS

| | | |
|---|---|---|
| 0069579 | 7/1982 | European Pat. Off. . |
| 2642341 | 1/1990 | France . |
| 3215795 | 4/1982 | Germany . |

*Primary Examiner*—Lowell A. Larson
*Attorney, Agent, or Firm*—Diller, Ramik & Wight

[57] ABSTRACT

A ram (40,50) of a press comprises metal sleeve (41,51), a hollow core (42, 58), a first end piece 42A, 52 attached to one end of the rod and a second end piece 46, 54 attached to the other end 47 of the ram to support a tool, the hollowcore being made of a material lighter than that of the sleeve. The benefit is a ram of reduced weight to minimize inertia forces arising during use.

43 Claims, 2 Drawing Sheets

RAM FOR LONG STROKE PRESS

BACKGROUND OF THE INVENTION

This invention relates to a ram for a press for drawing hollow articles, more particularly but not exclusively to a ram for a long stroke press used to iron the side wall of a drawn metal cup to make a taller can. In the can industry these long stroke presses are sometimes called bodymakers.

SUMMARY OF THE INVENTION

U.S. Pat. No. 3,733,881 (GRIGORENKO) describes a press in which a first punch draws a metal cup and a second longer punch on a ram pushes the cup through wall ironing dies.

Typical presses used for ironing the side wall of a metal cup to make a can are described in U.S. Pat. No. 3,735,629 (STANDUN INC) and U.S. Pat. No. 4,173,138 (STANDUN INC). In these presses a long ram is supported in bearings on a press frame for horizontal linear motion toward and away from a tool pack comprising several ironing dies, a stripper and a bottom doming station which abuts the end of a punch on the ram. The ram is driven through a drag link at one end of a lever pivoted at the other end on the press frame. The lever is connected to driven crank by a connecting rod.

In order to fulfil several requirements the ram has to be:

(a) rigid and strong enough to deliver the working load onto a punch mounted on the end of the ram;

(b) hollow to deliver venting air necessary to permit removal of the wall ironed can from the punch;

(c) have means to fix the punch to one end of the ram and a driven coupling at the other end; and (d) have an exterior surface finish suitable to survive prolonged cyclic motion through the bearings.

Hitherto the rams have been machined from solid metal. However, such rams are heavy and so generate substantial inertia forces during reciprocation which put substantial forces on the drive mechanism and bearings. Furthermore, undesirable vibration arises in the punch and ram partly due to impact of the punch at the bottom forming station and partly due to varying droop of the long ram as it retracts to the support of the bearings.

One objective of this invention is to provide a lighter ram comprising an exterior metal sleeve to slide in the bearings of the press and a core of material lighter than the sleeve metal.

Another objective is to provide means to attenuate vibrations arising in the ram, by provision of a suitable core material within the metal sleeve.

The use of non metallic, and therefore lighter, materials in connecting rods is described in DE-OLS-3215795 (FESTO) and U.S. Pat. No. 4,425,820 (SWOZIL/SIGRI). In DE-OLS-3215795 a compressor is described in which the piston has a hollow actuating rod made of carbon fibre reinforced glass fibre but no exterior metal sleeve is described as is necessary for sliding motion in our press bearings. In U.S. Pat. No. 4,425,820 a connecting rod for an internal combustion engine is described as comprising a composite material formed from reinforcement fibres wound in a form of an endless loop with constant cross sectional shape which is pinched to define a "little end" loop and splayed to define the "big end" bearing. The fibres are enclosed by a jacket of aluminium to protect the epoxy resin core, reinforced by carbon or glass fibres, from atack by engine oil. Whilst these prior art documents show that connecting rods of composite material can survive cyclic loading including longitudinal compression and tension they do not address our problems arising from sliding wear in the bearings of a press and attenuation of vibrations arising in a long hollow ram driving a punch, on the ram, against a press tool. Accordingly this invention provides a press, for drawing hollow articles from sheet metal, comprising a frame to support a press tool; a ram movable towards and away from the tool support, and bearings on the frame which support the ram, wherein, the ram comprises a metal sleeve; a hollow core, made of material lighter than that of the sleeve, fitted in the sleeve; a first end piece, adapted for coupling to driving means, attached to one end of the ram; and a second end piece, adapted to support a punch, attached to the other end of the ram.

In a first embodiment the core material is a resin bonded carbon fibre. Preferably the core material comprises at least two layers of carbon fibre. Typically, a first layer of said layers has the carbon fibre oriented at 90° to the longitudinal axis of the ram or rod and the second layer has the carbon fibre oriented at 45° to the axis of the ram or rod.

The first end piece may fit between a core portion of reduced diameter and the metal sleeve; the first end piece is preferably bonded by adhesive to the core portion of reduced diameter.

The second end piece is tubular and bonded to a second core portion of reduced diameter. If desired, the second end piece may have an outwardly directed flange bonded to both sleeve and core.

If desired a metal core tube may be fitted inside the hollow of the reinforced resin core.

In a second embodiment of the ram or rod, a metallic core tube extends along the length of the interior of the core material. In this second embodiment, the core material is chosen from natural rubber, a polymer such as polyurethane, or plastic material such as an alumina cement.

In a preferred embodiment the ram or push rod comprises a steel sleeve having a metal core tube supported concentrically therein by annular blocks, with the void between the sleeve and core tube filled with a non metallic material such as rubber or other elastomeric material.

Various embodiments will now be described by way of example and with reference to the accompanying drawings in which:

DESCRIPTION OF THE PREFERRED EMBODIMENTS

Figure 1:
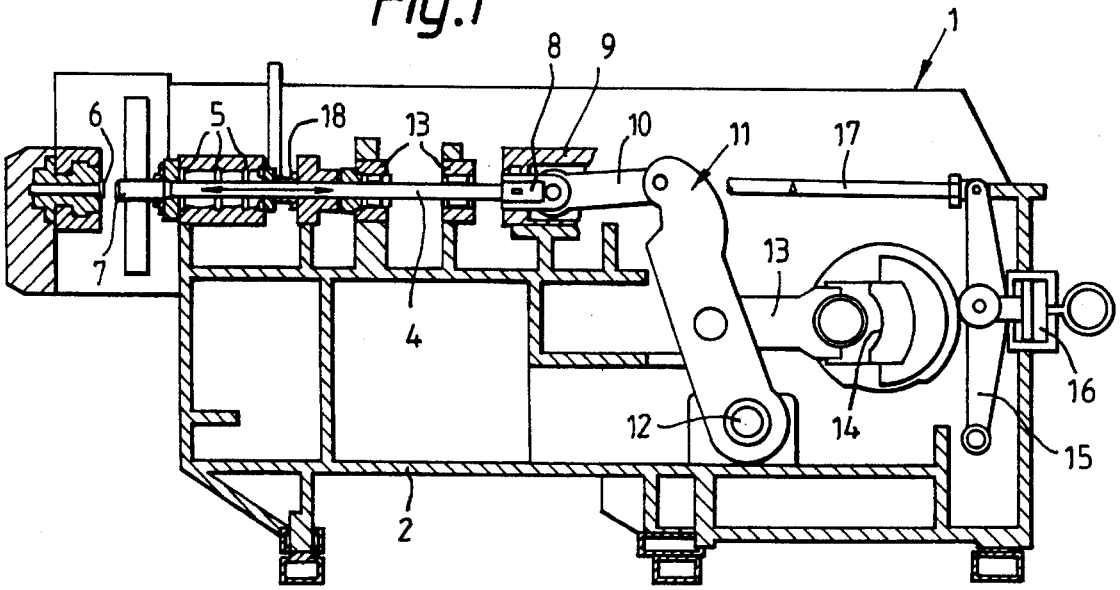
FIG. 1 is a diagrammatic sectional side view of a known can body maker.

FIG. 1 shows a long stroke press, or wall ironing machine for making can bodies from a cup drawn from sheet metal. In FIG. 1 the press 1 comprises a frame 2, a pair of hydrostatic bearings 3, a ram 4 supported in the bearings for linear motion through a series of ironing rings 5 towards and away from a bottom doming tool 6 supported on the frame, There is a punch 7 mounted on the end of the ram nearest the bottom doming tool 6, At the other end of the ram there is a coupling 8 fixed to the ram. The coupling is supported on a slide 9, The coupling is operably connected by a drag link 10 to the top end of a lever 11 which pivots at the other end in a pivot 12 fixed to the frame, The lever is driven at its mid-point by a connecting rod 13 driven by a crank 14.

The press 1 also has a second action linkage comprising a second lever 15 held against cam profiles on the crank 14 by a buffer 16. The second lever drives a pair of push rods, one of which is denoted 17, to drive a crosshead, not shown, to actuate a blank holder 18, The solid push rods 17 and hollow ram 4 are heavy metal articles which generate inertia forces which it is desirable to reduce.

Figure 2:
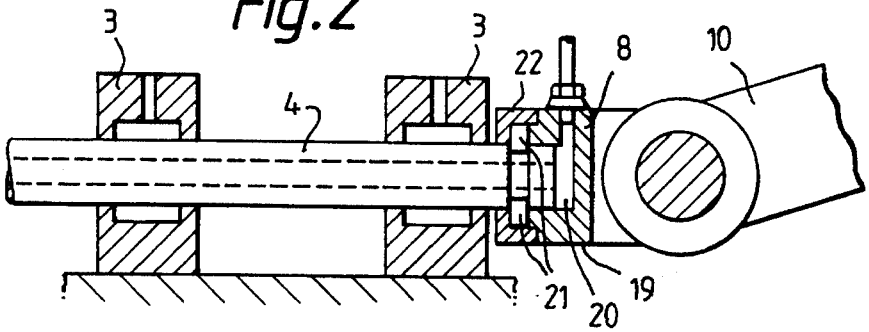
FIG. 2 is a simplified fragmentary view of the driven end of the ram shown in FIG. 1.

FIG. 2 shows the ram 4 in bearings 3, the coupling 8 and part of the drag link 10. The ram 4 has a hollow along its entire length as shown by dashed lines. The coupling 8 comprises a body 19 defining a cavity 20 which communicates with the hollow of the ram 4 for delivery of air to vent the drawn can during stripping from the punch. The end of the ram fits into the cavity and is retained by collets 21 engaged with a circumferential groove in the surface of the ram. The collets are held in the ram groove by a collar 22.

Figure 3:
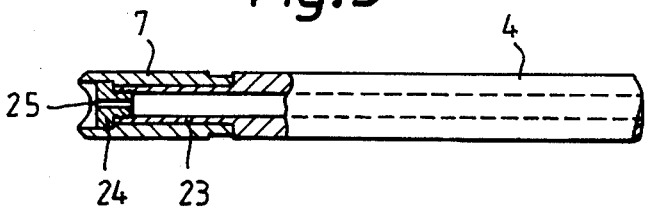
FIG. 3 is a simplified fragmentary view of the punch and other end of the ram shown in FIG. 1.

FIG. 3 shows the other end of the ram 4 and the punch 7 mounted on a reduced diameter portion 23 of the ram. The punch is held on the ram portion 23 by a threaded plug 24 which has a passage way 25 through it.

The coupling fixing and punch fixing have proved satisfactory in mass production of cans so it is desirable to retain them in any improved lightweight ram.

Figure 4A:
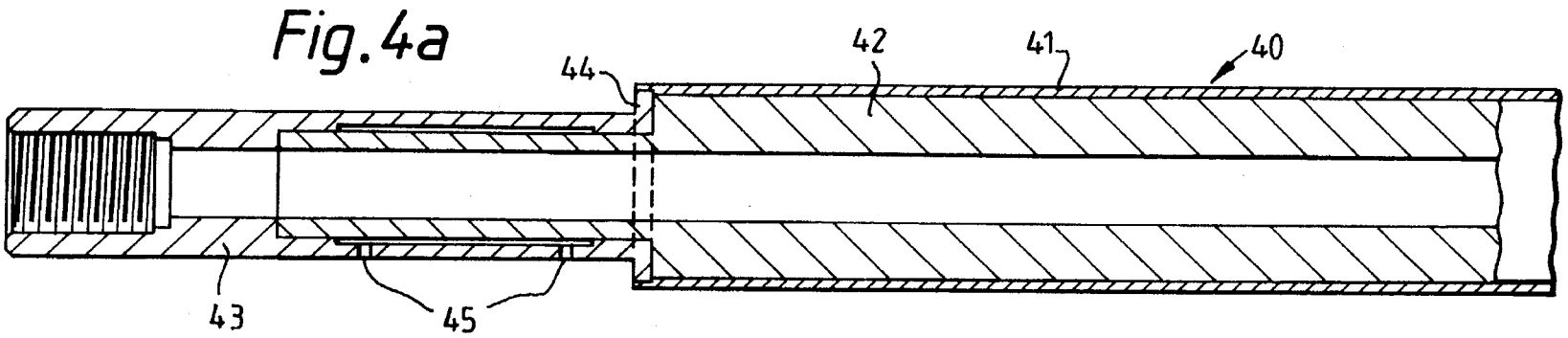
FIG. 4*a* and 4*b* are sectioned side views of a first ram according to this invention.
Figure 4B:
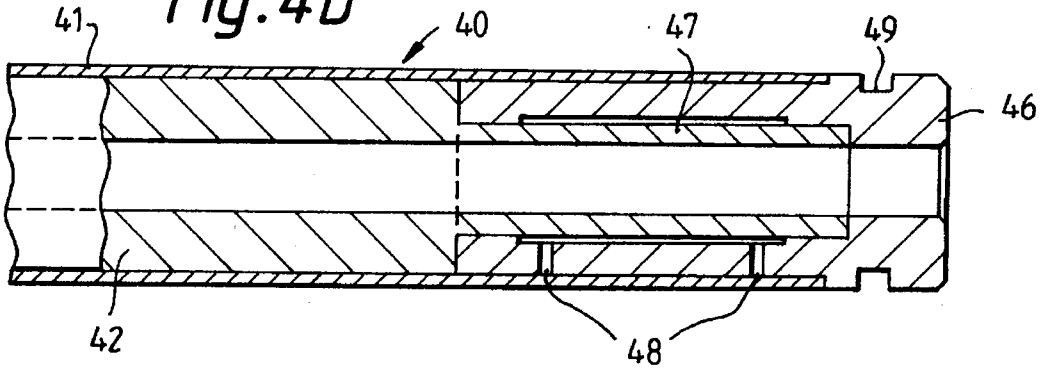

FIGS. 4*a* and 4*b* show the punch end and coupling end of a first ram according to the invention.

In FIG. 4*a*, the ram 40 comprises a steel sleeve 41 about 1500 mm long having wall thickness of 3 mm. The exterior surface of the tube is lapped to a 0.2 micron finish. The steel sleeve is bonded to an inner tubular core 42 made of resin bonded woven carbon fibre. Preferably, the core comprises several layers of carbon fibre. The fibre strands being at 45° or 90° to the longitudinal axis of the core and alternating from one layer to the next. The core 42 has a portion 42A of reduced outside diameter onto which is bonded a tool steel end piece 43 having a flange 44 at one end to fit in the extremity of the steel sleeve 41. The end piece is bonded to the portion of reduced diameter by adhesive which is introduced through radial bores 45. A punch, such a punch 7 as already described, is fitted on the end piece 43.

In FIG. 4*b*, the ram 40 has a second end piece 46 bonded to a portion of reduced diameter, 47, the carbon fibre core 42 by introduction of adhesive through side holes 48. The steel sleeve 41 is then fitted over the carbon fibre core 42 and end piece 46. The end piece has a groove 49 into which collets are fitted to attach the drive coupling 8 as already described.

Whilst this carbon fibre ram provided a useful reduction in ram weight it is expensive in both materials and labour to manufacture.

Figure 5:
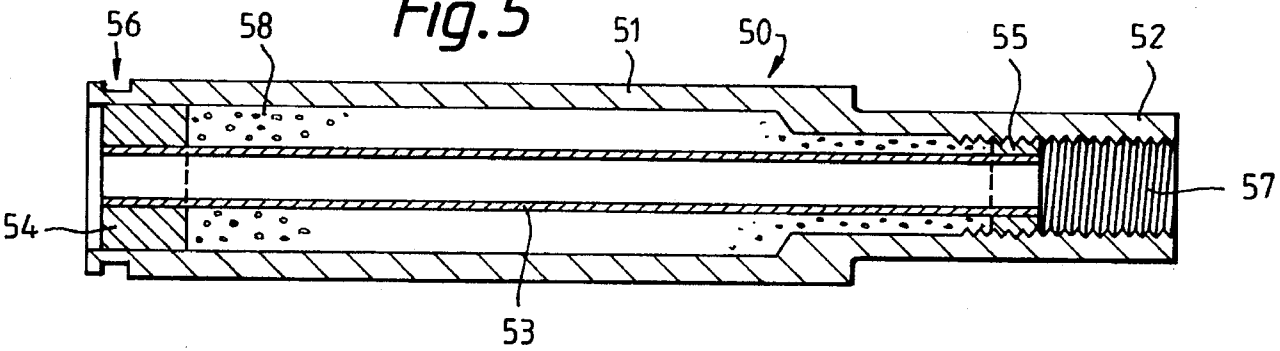
FIG. 5 is a sectioned side view of a second ram according to the invention.

FIG. 5 shows on reduced scale a second form of ram 50 comprising a steel sleeve 51 having a reduced diameter portion 52 to receive a punch and a groove at the other end to receive a drive coupling. A metal core tube 53 is supported in the sleeve by a first annular block 54 at the grooved end 56 of the sleeve and a second annular block 55 near the threaded end 57 of the reduced diameter portion 52. A plastic material such as polyurethane, aluminium, concrete etc 58 is packed into the void between the core tube 53 and sleeve 51 before the annular block 54 is fitted. After closing of the sleeve the plastic material is cured or allowed to set. Suitable plastic materials include natural rubber, polymers such as polyurethane or cements such as alumina cement.

The benefits arising from both embodiments described are:

(a) some damping of vibration in the ram is achieved within the ram by dissipating vibration energy into the non metallic material;

(b) the natural frequency of vibration of the ram is modified without affecting its stiffness.

(c) the mass of the ram is reduced so that the vibrational energy developed during use is less than would arise with a solid metal ram.

Although a preferred embodiment of the invention has been specifically illustrated and described herein, it is to be understood that minor variations may be made in the apparatus without departing from the spirit and scope of the invention, as defined the appended claims.

We claim:

1. A press for drawing hollow articles from sheet metal, comprising a frame to support a press tool, a ram movable towards and away from the tool support, bearings which support the ram, wherein the ram comprises a metal sleeve; a hollow core, made of a material lighter than that of the sleeve, fitted in the sleeve; a first metal end piece adapted for coupling to driving means attached to one end of ram; a second metal end piece adapted to support a punch attached to the other end of the ram, and adhesive means for attaching said metal end pieces to said hollow core.

2. A press according to claim 1 wherein the core material of the ram is a resin bonded carbon fibre.

3. A press according to claim 2 wherein the core material of the ram comprises at least two layers of carbon fibre.

4. A press according to claim 3 wherein the core of the ram has a first layer of said layers has the carbon fibre oriented at 90° to the longitudinal axis of the ram or rod, and the second layer has the carbon fibre oriented at 45° to the axis of the ram or rod.

5. A press according to claim 1 wherein the first end piece of the ram fits between a core portion of reduced diameter and the metal sleeve.

6. A press according to claim 5 wherein the first end piece of the ram is bonded by said adhesive means to the core portion of reduced diameter.

7. A press according to claim 1 wherein the second end piece of the ram is tubular and is bonded by said adhesive means to a second core portion of reduced diameter.

8. A press according to claim 7 wherein the second end piece of the ram has an outwardly directed flange bonded by said adhesive means to both said sleeve and core.

9. A press according to claim 1 wherein a metallic core tube extends along the length of the interior of the core material.

10. A press according to claim 9 wherein a metallic core tube extends along the entire length of the interior of the core material.

11. A press according to claim 10 wherein the core material is chosen from at least one of natural rubber, a polymer, and plastic material.

12. A press for drawing hollow articles from sheet metal comprising a frame, said frame including means for supporting a press tool, a ram, means for imparting horizontal reciprocal movement to said ram substantially toward and away from said press tool supporting means, said ram including an exterior relatively thin metal sleeve and an internal relatively thick hollow core, said hollow core being made of material lighter than the metal of said sleeve; said hollow core being constructed and arranged to impart strength, stiffness and vibration damping to said ram; spaced bearing means for slidably supporting said exterior metal sleeve during reciprocal movement of said ram during movement both toward and away from said press tool supporting means, means at a first end of said ram for coupling said ram to said reciprocal movement imparting means, and means at a second end of said ram for supporting a punch.

13. The press as defined in claim 12 wherein said metal sleeve is steel.

14. The press as defined in claim 12 wherein said hollow core is non-metallic material.

15. The press as defined in claim 12 wherein said metal sleeve is steel, and said hollow core is non-metallic material.

16. The press as defined in claim 12 wherein said hollow core includes first and second tubular end portions at said ram respective first and second ends, first and second connecting pieces at said respective first and second ends, and said first connecting piece includes said ram coupling means.

17. The press as defined in claim 16 wherein said first connecting piece and said first tubular end portion are in substantially concentric relationship to each other.

18. The press as defined in claim 17 wherein said second tubular end portion projects axially beyond said metal sleeve.

19. The press as defined in claim 17 wherein said second tubular end portion projects axially beyond said metal sleeve, and said second connecting piece projects axially beyond said second tubular end portion.

20. The press as defined in claim 17 wherein said first connecting piece includes axially spaced annular faces, a first of said annular faces being in abutment with an annular face of said metal sleeve, and a second of said annular faces being in abutment with an annular face of said hollow core.

21. The press as defined in claim 17 wherein said first connecting piece includes axially spaced annular faces, a first of said annular faces being in abutment with an annular face of said metal sleeve, a second of said annular faces being in abutment with an annular face of said hollow core, and said second connecting piece includes axially spaced first and second annular faces in abutment with respective first and second annular faces of said hollow core.

22. The press as defined in claim 16 wherein said second connecting piece and said first tubular end portion are in substantially concentric relationship to each other.

23. The press as defined in claim 22 wherein said second connecting piece includes axially spaced first and second annular faces in abutment with respective first and second annular faces of said hollow core.

24. The press as defined in claim 16 wherein said first connecting piece and said first tubular end portion are in substantially concentric relationship to each other, and said second connecting piece and said second tubular end portion are in substantially concentric relationship to each other.

25. The press as defined in claim 16 wherein said first connecting piece and said first tubular end portion are in substantially concentric encircling relationship to each other.

26. The press as defined in claim 16 wherein said second connecting piece and said second tubular end portion are in substantially concentric encircling relationship to each other.

27. The press as defined in claim 16 wherein said first connecting piece and said first tubular end portion are in substantially concentric relationship to each other, and said second connecting piece and said second tubular end portion are in substantially concentric relationship to each other.

28. The press as defined in claim 16 wherein said first connecting piece and said first tubular end portion are in substantially concentric relationship to each other, and adhesive means for bonding said first connecting piece and said first tubular end portion to each other.

29. The press as defined in claim 16 wherein said second connecting piece and said second tubular end portion are in substantially concentric relationship to each other, and adhesive means for bonding said second connecting piece and said second tubular end portion to each other.

30. The press as defined in claim 16 wherein said first connecting piece and said first tubular end portion are in substantially concentric relationship to each other, said second connecting piece and said second tubular end portion are in substantially concentric relationship to each other, and adhesive means for bonding said first and second connecting pieces to said respective first and second tubular end portions.

31. The press as defined in claim 16 wherein said first connecting piece and said first tubular end portion are in substantially concentric relationship to each other with said first connecting piece being in exterior encircling relationship to said first tubular end portion.

32. The press as defined in claim 16 wherein said second connecting piece and said second tubular end portion are in substantially concentric relationship to each other with said second connecting piece being in exterior encircling relationship to said second tubular end portion.

33. The press as defined in claim 16 wherein said first connecting piece and said first tubular end portion are in substantially concentric relationship to each other, said second connecting piece and said second tubular end portion are in substantially concentric relationship to each other, and said first and second connecting pieces being in exterior encircling relationship to said respective first and second tubular end portions.

34. The press as defined in claim 12 wherein said hollow core includes first and second tubular end portions at said ram respective first and second ends, first and second connecting pieces at said respective first and second ends, and said second connecting piece includes said punch supporting means.

35. The press as defined in claim 12 wherein said hollow core includes first and second tubular end portions at said ram respective first and second ends, first and second connecting pieces at said respective first and second ends, said first connecting piece includes said ram coupling means, and said second connecting piece includes said punch supporting means.

36. A press for drawing hollow articles from sheet metal comprising a frame, said frame including means for supporting a press tool, a ram, means for imparting horizontal reciprocal movement to said ram substantially toward and away from said press tool supporting means, said ram including an exterior metal sleeve and internal tube, said metal sleeve and tube being in substantially coaxial spaced relationship to each other and defining a generally annular chamber therebetween, means in said annular chamber for imparting strength, stiffness and vibration damping to said ram; spaced bearing means for slidably supporting said exterior metal sleeve during reciprocal movement of said ram during movement both toward and away from said press tool supporting means, means at a first end of said ram for coupling said ram to said reciprocal movement imparting means, and means at a second end of said ram for supporting a punch.

37. The press as defined in claim 36 including first and second means at said respective ram first and second ends for closing said annular chamber.

38. The press as defined in claim 37 wherein said metal sleeve is relatively thick and said internal tube is relatively thin.

39. The press as defined in claim 37 wherein said strength, stiffness and vibration damping means is material chosen from one of natural rubber, a polymer and plastic material.

40. The press as defined in claim 36 wherein said metal sleeve is relatively thick and said internal tube is relatively thin.

41. The press as defined in claim 40 wherein said strength, stiffness and vibration damping means is material chosen from one of natural rubber, a polymer and plastic material.

42. The press as defined in claim 36 wherein said metal sleeve is relatively thick and said internal tube is relatively thin, and said internal tube is metal.

43. The press as defined in claim 36 wherein said strength, stiffness and vibration damping means is material chosen from one of natural rubber, a polymer and plastic material.

* * * * *